United States Patent [19]

Glock

[11] Patent Number: 4,683,711

[45] Date of Patent: Aug. 4, 1987

[54] THREAD MONITORING DEVICE

[75] Inventor: Alfred Glock, Stuttgart, Fed. Rep. of Germany

[73] Assignee: SKF Textilmaschinen-Komponenten GmbH, Stuttgart, Fed. Rep. of Germany

[21] Appl. No.: 880,073

[22] Filed: Jun. 30, 1986

[30] Foreign Application Priority Data

Jul. 1, 1985 [DE] Fed. Rep. of Germany ..... 3523481

[51] Int. Cl.[4] ..... D01H 13/16; D01H 13/18

[52] U.S. Cl. ..... 57/81; 19/0.21; 19/0.25; 57/80; 57/86

[58] Field of Search ..... 57/78, 80, 81, 84, 86, 57/87; 19/0.2, 0.21, 0.25, 0.26

[56] References Cited

U.S. PATENT DOCUMENTS

| | | | |
|---|---|---|---|
| 4,450,677 | 5/1984 | Ronai-Horvath et al. | 57/86 X |
| 4,484,376 | 11/1984 | Glock et al. | 57/86 X |
| 4,501,114 | 2/1985 | Ronai-Horvath et al. | 57/86 X |

*Primary Examiner*—John Petrakes

[57] ABSTRACT

A spinning machine is provided with a thread monitoring device having a light source and a light sensitive cell to sense the thread running to a spindle from the front exit rollers. The thread monitor is formed of two parts, each having a housing arranged on either side of the thread. Within each housing is the light source and the light sensitive cell. The housings are each detachably connected to a slider which is adjustably held in a guide support that can be swivelled and locked in a carrier which is secured to the free end of a support rail running alongside and parallel to the roller supporting arm.

9 Claims, 3 Drawing Figures

Fig. 2
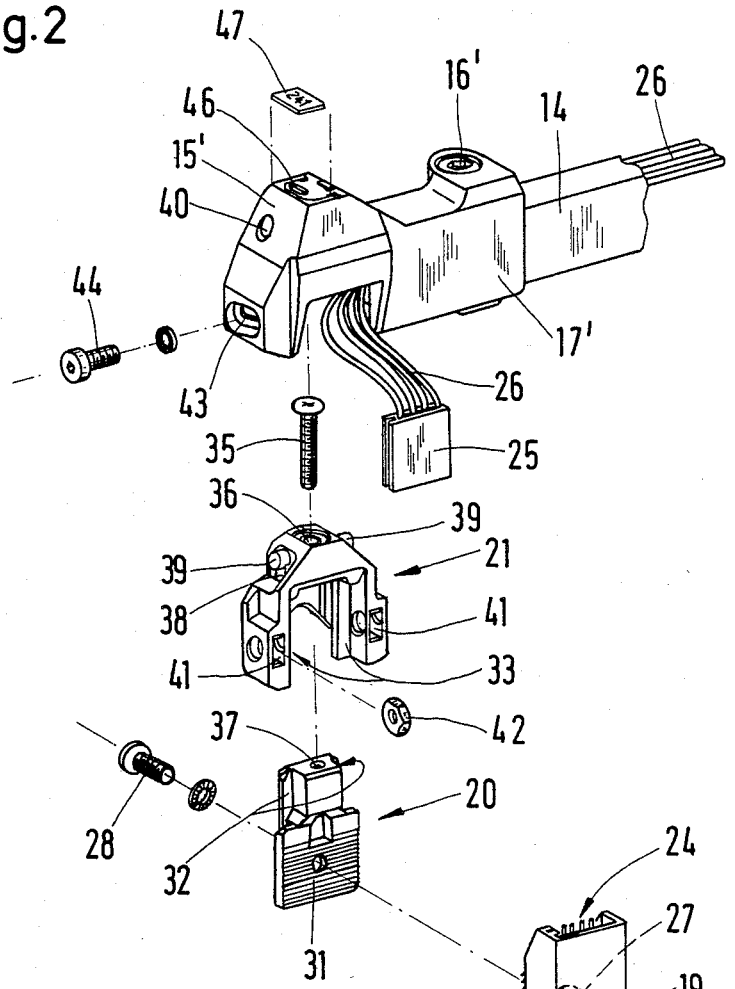
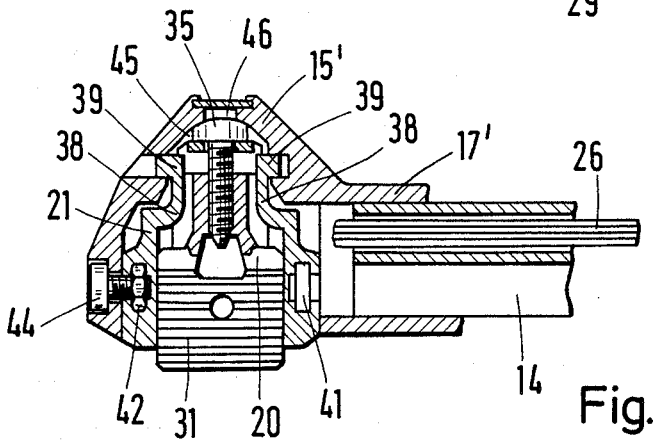
Fig. 3

THREAD MONITORING DEVICE

BACKGROUND OF THE INVENTION

The present invention relates to the construction of the monitoring device for sensing and controlling the passage of slubbing or fiber roving in the draw frame of a textile spinning machine.

A known drafting machine is provided with a draw frame having at least a set of inlet rollers for receiving the roving or sliver from a source, and a set of exit rollers spaced therefrom, between which the roving is drawn. The exit rollers, feed the drawn material, as thread or yarn to a bobbin or cop on which it is wound. The sets of rollers each comprise a driven lower and a pair of axial spaced (double) upper rollers permitting the drawing of two rovings side by side. The upper rollers are journalled in ranked pairs on a common supporting arm extending in the direction of drawing. Such a machine is disclosed in U.S. Pat. No. 4,450,677 dated May 29, 1984, which also provides means for sensing the proper winding of the drawn thread, including a light source and a photo-light receiving cell mounted at the exit end of the draw frame. A roving clamping device is activated after a break in the exiting thread has occurred, thus, preventing the feeding of additional roving to the draw frame.

In the thread monitoring device shown in U.S. Pat. No. 4,450,677 the light source and the light sensitive cell are arranged on separate components which can be adjusted and locked in positions relative to each other. For operational reasons these parts are situated near to the moving path of the thread emerging from the pair of exit rollers of the draw frame. During operation of the machine it is necessary to perform a great deal of thread-piecing and maintenance work which require a lot of manual activity in the area where the light and light sensitive cells are mounted, and in many instances tools are used. The danger thus exists that the above-mentioned sensitive thread cells are mounted, and in many instances tools are used. The danger thus exists that the above-mentioned sensitive thread monitoring components may suffer damage. If this happens, the most sensible course of action is to replace the damaged component (light source or light-sensitive cell) together with the part holding it with an undamaged component. In the case of the known thread monitoring devices this is accomplished by unscrewing the screw securing the component to the support bar. However, this screw is also the screw retaining the component in the position in which, with the help of an adjustment device, it was initially expertly adjusted in relation to the other functional components of the thread monitoring device and in relation to the moving thread path at the time the device was initially fitted to the machine. Consequently, replacing a damaged component with an undamaged one involves renewed adjustment of the thread monitoring device, requiring a great deal of time and expertise.

It is the object of the present invention to provide the component of the thread monitoring device which holds the light source and the light-sensitive cell such that it is easily installed in precise relationship to one another and to the thread path while permitting the exchange of a damaged component with an undamaged one and maintaining the already adjusted alignment of the parts in relation to one another.

These objects together with other objects and advantages are set forth in the following disclosure of the present invention.

SUMMARY OF THE INVENTION

In accordance with the present invention the draw frame of a spinning machine is provided with a thread monitoring device having a light source and a light sensitive cell, sensing the thread running to a spindle from the front exit rollers, and activating a clamping fixture associated with the roving being fed to the rollers, when the running thread breaks. The thread monitor is formed of two parts arranged to straddle the pair of threads produced by the paired rollers of a single supporting arm and each includes a housing for the light source and a housing for the light sensitive cell. The housings are each detachably connected to a slider which is adjustably held in a guide support that can be swivelled and locked in a carrier which is secured to the free end of a support bar running alongside and parallel to the roller supporting arm.

In accordance with the present invention the carrier, guide support, slide and housing for each part of the monitoring device are identical to each other, and are merely arranged in mirror image facing relationship.

Preferably the swivel axis of the guide support is parallel to the longitudinal axis of the support bar, and the slider and the guide support incorporate sliding surfaces which run at right angles to the longitudinal axis of the supporting bar. The adjustment of the slider in the guide support is achieved by means of a self-locking screw engaging in a wall of the slider and being accessible via an opening in the wall. The shaft of the screw passes through the guide support and the head of the screw is held in an axially immovable position in a space between the guide support and the carrier.

The design of the thread monitoring device is, therefore, such that the housing which supports the light source and/or the light sensitive cell is no longer a component which, as such, is to be adjusted when the monitoring device is set up or repaired. It is only the carrier, slide and support guide which require initial adjustment, and remain thereafter fixed in place even though the housing is replaced. The housing is moved and optimally positioned in conjunction with these other components and does not require adjustment. The fact that the housing is detachable from and interlocks positively with one of these other adjustable components means that a replacement housing may be fitted into the carrier in exactly the same position as the fautly housing previously removed. Housings can thus be replaced by personnel who do not need to know how to adjust the thread monitoring device on the machine, nor does it require a great deal of time.

Full details of the present invention is set forth in the following disclosure and is illustrated in the appended drawing.

BRIEF DESCRIPTION OF THE DRAWINGS

In the drawings:

FIG. 2 is an exploded view of the individual components of the thread monitoring device also in perspective, which are arranged so as to be adjustable and removable in a carrier attached to a supporting bar; and FIG. 3 is a side view of a section through the holder, with the inserted guide support and slider of the thread monitoring device.

DESCRIPTION OF THE INVENTION

Figure 1:
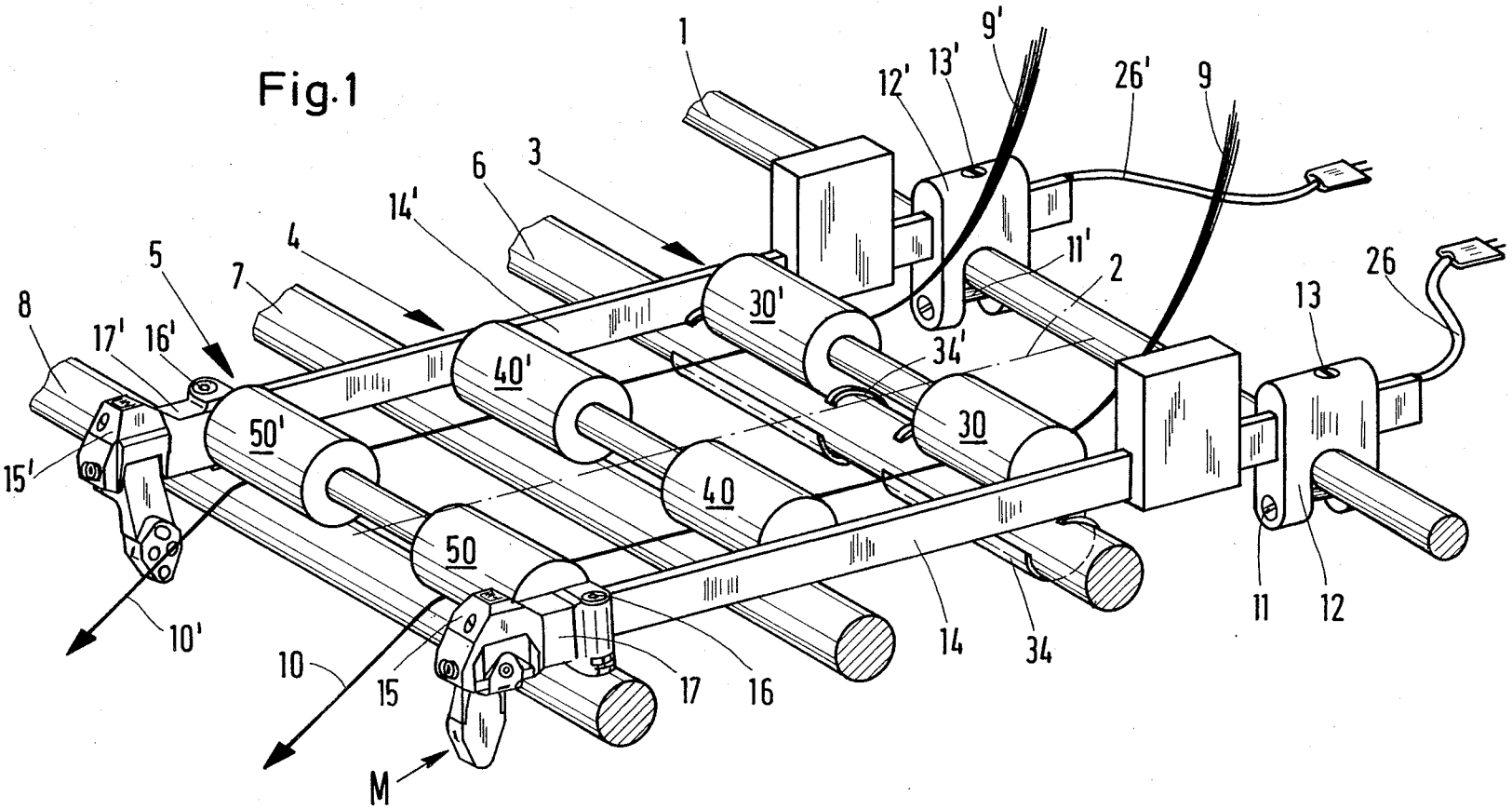
FIG. 1 is a perspective view of a drawing frame device equipped with double upper rollers with thread monitoring device sensing the continuous running of the two roving threads leaving the drafting rollers.

In the drawing frame illustrated in FIG. 1 a support rod 1, running the length of the entire spinning machine, supports a plurality of support arms, the longitudinal direction of one of these support arms being indicated by the dot-dash line 2. Mounted on each support arm 2, by their respective common axles are a pair of entry rollers 3, a pair of top apron rollers 4, and a pair of exit or front rollers 5. The individual rollers 30, 30', and 40, 40', and 50, 50' of the pairs 3, 4 and 5 are freely rotatable and as illustrated in FIG. 1 rest in their operating position, under the load given to them by the supporting arm 2, on associated lower rollers 6, 7 and 8 respectively. The lower rollers 6, 7 and 8 are driven through conventional drive means, not illustrated. A roving 9 to be stretched or drawn is fed between the upper rollers 30 and the lower roller 6 passing, through the rollers 40 and 7, 50 and 8, passing outwardly as a thread 10. Similarly, a roving 9' is drawn to a thread 10' through the rollers 30', 40', and 50'. Each of the threads 10, 10' are wound on a cop; each seated on a spindle, also not illustrated in the drawings.

The continuity of either of exiting threads 10 and 10' is monitored by means M and upon sensing a break in either thread activates a clamping device 34, 34' as a result of which the continued running of the roving is arrested thereby preventing loss of material and lapping of the roving on the running rollers.

In accord with the invention, an auxiliary supporting bracket 12 is mounted on the rod 1 so that it can be adjusted rotatively and laterally with respect to the rod 1 and thereafter held in fixed position by a screw 11. A bearing rail 14 is inserted in a bore formed in the bracket 12 so as to be movable lengthwise generally parallel to the direction of the roller support arm 2 and is tightly clamped by a screw 13. The supporting bracket 12 is thus adjustably securable on the support rod 1 so as to be selectively pivotable about and movable along the axis of the rod while the bearing rail 14 is mounted to extend laterally to the upper rollers 30, 40 and 50, and parallel to the supporting arm 2 and at right angles to the rollers 30, 40 and 50 so that movement of the supporting arm 2 for lifting off the upper rollers from and, respectively, then placing the same on the lower rollers can be carried out unimpeded.

Up to this point, the draw frame is similar to that disclosed in the aforementioned U.S. Pat. No. 4,450,677 and further reference can be made to this patent for other details.

The present invention is concerned with the construction for the mounting of the monitoring devices illustrarted in general by the letter M in the drawings. Since the monitoring devices M are identical, the one assigned to the roving 9 and the thread 10 is shown in the drawing bearing whole numbers while the monitoring device assigned to the roving 9' and the thread 10' are denoted by the identical reference numbers supplemented by the apostrophe symbol. In the detail of FIG. 2, the monitoring device 15' (on the far side of the draw frame as seen in FIG. 1) is shown and described in the following text as it more clearly faces the reader. In FIG. 2, however, since the components are identical, the apostrophe is omitted except where necessary for better understanding.

The monitoring device comprises a U-shaped carrier 15 which is slidably mounted at the end of the bearing rail 14 and is secured in the desired position within the exit zone of the drafted thread 10 by a locking screw 16 passing through a neck 17, so that the carrier 15 extends cantilevered over the end of the bearing rail 14. The inside profile of the carrier 15 corresponds to the cross section of the bearing rail 14. The two carriers 15 are arranged on respective bearing rails 14 in mirror image to each other, i.e., as right and lefthand carriers 15 and 15', respectively, as can be seen from FIG. 1, facing each other on each side of the draw frame. In addition to the carrier 15, each monitoring device comprises, in gross, a housing 19, a slider 20 and a U-shaped guide support 21.

Mounted in the housing 19 is an electric light source 22 and a light sensitive cell 23, subdivided into three part cells, each of which is fitted separately into the wall of the housing 19. The necessary electric wiring leads for the cells 23 are connected to a pin type strip plug 24, which, in turn, can be connected to a corresponding strip socket 25 at the end of a flat cable 26, which is carried inside the bearing bar 14. The cable 26 terminates at the head of the machine in the conventional current supply and switching apparatus, providing operation of the monitoring device and clamping device, as well. The housing 19 is adjustably secured so as to be releasable from the slider 20 by means of a nut 27 immovably embedded in the housing 19 and a screw 28 passing through the slider 20. The contact surfaces between the housing 19 and the slider 20 are provided with intermeshing grooved and ridged surfaces 29 and 31, respectively, that lock together in a predetermined position, ensuring that the two parts can only be joined together in a single position relative to one another.

The slider 20 fits into the legs of the U-shaped guide support 21 and is provided with sliding surfaces 32 which correspond to similar sliding surfaces 33 along the inside of the legs of the guide support 21. The slider 20 is thus movable up and down within the guide support 21, in a direction of movement which is at right angles to the longitudinal axis of the bearing bar 14. The longitudinal adjustment of the slider 20 within the connecting web of the guide support 21 is achieved by means of a screw 35, the shaft of which passes through a hole 36 in the guide support 21 and, with its sharp-edged thread, cuts into a cylindrical recess 37 in the top of the slider 20, thus providing a self-locking connection between the slider 20 and the guide support 21.

The guide support 21 fits within the U-shaped body of the carrier 15. The connecting web of the guide support 21 has a transverse opening into which two opposing and freestanding tongues 38 are inserted, bridging the legs of the guide support. The tongues 38 are elastically moved towards each other and are formed at the free ends of each with a pair of laterally extending trunnions 39 which are journalled in openings 40 formed in the carrier parallel to the axis of the bearing rail. When fitting the O-shaped guide support 21 into the similarly shaped interior bight of the carrier 15 as seen in FIGS. 2 and 3, the trunnion 39 on each of the two tongues 38 initially "give" a little as a consequence of the elasticity of the tongue, and finally click into place in bearing openings 40 formed in the carrier 15. Thus, the guide support 21, together with the slider 20 supported by it and the housing 19 attached to the slider is secured in the carrier 15 so that pivoting is possible around the rotational axis of the trunnion 39, parallel to the longitudinal axis of the bearing rail 14.

Both legs of the guide support 21 , however, contain laterally open recesses 41 into which a nut 42 can be immovably fitted, and a transverse threaded hole 41a aligned with the embedded nut 42. Since the guide support 21 together with the attached slider 20 and housing 19, is fitted both in either the right-hand holder 15 and the left-hand holder 15', in practice this nut 42 is actually fitted in that recess 41 which adjoins the unsupported front leg of the cantilevered carrier 15. Both legs of the carrier 15 contain a threaded hole 43 running concentrically to the hole 4a so that a screw 44 may be screwed into the nut 42. Thus, the guide support is pivotal about the trunnion axis and by tightening the screw 44, the guide support 21 can be secured in any desired pivot position within the carrier 15.

As will be clearly seen from FIG. 3, the inside surface of the top of the carrier 15 is dome shaped so that a gap 45 exists above the top of the guide support 21. The clearance provided by this gap 45 is such that holding the slide 20, the screw 35 is accessible, and in whatever position may be turned, it is locked in an axially immovable condition abuttingt the surface of the carrier 15. The domed-shaped inside surface of the carrier conforms to the rounded surface of the head of the screw 35 and is concavedly shaped in such a way that the locked axial position is retained in all pivoting positions of the guide support 21 within the carrier 15. The head of the screw 35 is accessible for adjustment with the necessary tool through an opening 46 formed in the top of the carrier 15. Because the head of the screw is held in place by either the carrier or the guide support, every turn of screw 35 thus produces a movement of the slider 20 upwards or downwards, relative to the guide support 21. When adjustment has been carried out, the opening 46 can be covered by the appropriate clip-in cover 47 so as to protect the interior from dirt accumulation. The cover can also bear the serial number of the thread monitoring device.

By means of the adjustment and locking facilities of each of the bearing rails 14 in the supporting bracket 12, the carrier 15 on the bearing rail 14, the guide support 21 in the carrier 15 and the slider 20 in the guide support 21 as described above, the pairs of light sources 22 and light sensitive cells 23 can be optimally adjusted in relation to one another and to the paths of the respective threads 10 and 10'. An electrical measuring device may be used to insure optimal light passage, when initially adjusting the devices. The housing 19 is secured to the slides 20 after proper adjustment has been made at specific relative positions one to another. This adjustment position will remain unchanged even when a housing 19 with a damaged light source 22 and/or light sensitive cell 23 is replaced since the associated housings and slides can be assembled in only one predetermined position, and since no other component part is removed or disturbed during such replacement. Replacement is effected simply by loosening the screw 28 and fitting a new housing 19 with properly functioning components onto the guide support 21 and retightening screw 28. The intermeshing surfaces 29 and 31 lock the replacement housing 19 in exactly the same position previously occupied by the other housing 19.

The simple assembly, the adjustability to the machine, and the manifold possiblities of adjustment of the thread monitor components make it possible to use the device with the draw frames of variable design and draft zone operating conditions.

Preferably, all the component parts of the sensing device, namely, carrier 15, guide support 21, slider 20 and housing 19 are made of plastic although one or more of such parts can be formed of metal. Plastic is preferred, because of the ease in replicating exactly all of the parts so that they are easily interchangeable. Consequently, although right and left handed sensing devices are ultimately obtained, each is identical with the other.

Various modifications, changes and alternative embodiments have been disclosed here, others will be obvious to those skilled in this art. Accordingly, the present disclosure is intended to be illustrative only and not limiting of its scope, which is defined only by the appended claims.

What is claimed is:

1. In the system for photo-electrically monitoring the continuity of thread running to a spindle from a pair of exit rollers of a drafting frame having double top rollers held by a common pivotal supporting arm, the system including a pair of thread monitoring devices each mounted at the end of a bearing rail arranged parallel to the direction of the running thread, the improvement wherein each monitoring device comprises a light source and light sensitive cells, a housing in which said light source and cells are fixedly mounted, a slider on which said housing is detachably connected in a predetermined position, a guide support in which said slider is held, and a carrier on which said guide support is mounted, said carrier being axially adjustable along said bearing rail, said guide support being mounted to said carrier to pivot about an axis coextensive with the axis of said bearing support rail and said slider being mounted on each guide support adjustable at right angles to the axis of said bearing rail.

2. The system according to claim 1, wherein the housings are arranged in opposition to each other so that the respective light sources are arranged in association with the opposite light sensitive cells.

3. The apparatus according to claim 1, wherein the swivel axis of the guide support is parallel to the longitudinal axis of the bearing rail.

4. The apparatus according to claim 1, wherein the slider and the guide support have sliding contact surfaces which run at right angles to the longitudinal axis of the bearing rail.

5. The apparatus according to claim 4, wherein the slider is adjustably mounted in the guide support by means of a screw in self-locking engagement in a wall of the slider and being accessible via an opening, the shaft of said screw passing through the guide support and the head of said screw being held in an axially immovable position in a gap between the guide support and the carrier.

6. The apparatus according to claim 5, including a cover for closing the opening in said carrier.

7. The system according to claim 1, wherein said carrier comprises a U-shaped body and a channel bracket slidably adjustable along the bearing rail, said guide support comprises a U-shaped body having a pair of laterally extending trunnions journalled within the bight of said carrier along an axis parallel to said bearing rail said slider comprising a body slidable between the legs of said guide support towards and away from the axis of said trunnions, and first screw means extending through the legs of said carrier and guide support for fixing said guide support in a selected pivotal position, and second screw means extending through said guide support for adjusting the slider in selected position with respect to the trunnion axis.

8. The system according to claim 7, wherein said second screw means has a head adapted to abut against the inside surface of said carrier so as to be axially unmovable with respect to said carrier, the rotation of said second screw means being translated into axial movement of said slider with respect thereto, said carrier having an opening providing access to said second screw means.

9. The system according to claim 8 including electric leads extending through said carrier, said leads and said housing being provided with cooperating plug and socket means for detachably connecting said leads to said light source and light sensitive cells.

* * * * *